US010774640B2

(12) United States Patent
Simon

(10) Patent No.: US 10,774,640 B2
(45) Date of Patent: Sep. 15, 2020

(54) CONSTRUCTION ELEMENT FOR CREATING A TUNNEL, TUNNEL COMPRISING SUCH AN ELEMENT AND METHODS FOR CONSTRUCTING SUCH AN ELEMENT AND SUCH A TUNNEL

(71) Applicant: AGENCE NATIONALE POUR LA GESTION DES DÉCHETS RADIOACTIFS, Chatenay-Malabry (FR)

(72) Inventor: Jean Simon, Vaulnaveys-le-Haut (FR)

(73) Assignee: AGENCE NATIONALE POUR LA GESTION DES DECHETS RADIOACTIFS, Chatenay-Malabry (FR)

( * ) Notice: Subject to any disclaimer, the term of this patent is extended or adjusted under 35 U.S.C. 154(b) by 0 days.

(21) Appl. No.: 15/312,947

(22) PCT Filed: May 20, 2015

(86) PCT No.: PCT/FR2015/051318
§ 371 (c)(1),
(2) Date: Nov. 21, 2016

(87) PCT Pub. No.: WO2015/177463
PCT Pub. Date: Nov. 26, 2015

(65) Prior Publication Data

US 2017/0167261 A1 Jun. 15, 2017

(30) Foreign Application Priority Data

May 21, 2014 (FR) ..... 14 01156

(51) Int. Cl.
*E21D 11/08* (2006.01)
*E21D 11/05* (2006.01)

(52) U.S. Cl.
CPC ..... *E21D 11/08* (2013.01); *E21D 11/05* (2013.01)

(58) Field of Classification Search
CPC ..... E21D 11/05; E21D 11/08; E21D 11/086
See application file for complete search history.

(56) References Cited

U.S. PATENT DOCUMENTS 3,545,213 A * 12/1970 Hofbauer ..... E21D 11/04 138/105
4,075,855 A * 2/1978 Meldner ..... E21D 11/05 405/152

(Continued)

FOREIGN PATENT DOCUMENTS

CN 103195086 A 7/2013
EP 0 089 403 A1 9/1983

(Continued)

OTHER PUBLICATIONS

Nov. 22, 2016 International Preliminary Report on Patentability issued in International Patent Application No. PCT/FR2015/051318.

(Continued)

*Primary Examiner* — Benjamin F Fiorello
(74) *Attorney, Agent, or Firm* — Oliff PLC

(57) ABSTRACT

Construction element for creating a tunnel, including a first incompressible layer of concrete and a second compressible layer securely fastened to the first layer to form a monoblock prefabricated construction element configured to be integrated in a section of the tunnel during creation of the tunnel, the second layer including a plurality of devices each having a solid body integrating an empty space.

16 Claims, 10 Drawing Sheets

(56) References Cited

U.S. PATENT DOCUMENTS

| | | | | |
|---|---|---|---|---|
| 4,363,565 | A | 12/1982 | MacKenzie | |
| 5,439,319 | A * | 8/1995 | Flanagan | E21D 11/385 156/287 |
| 6,761,504 | B1 * | 7/2004 | Brandenberger | E21D 11/383 405/150.1 |

FOREIGN PATENT DOCUMENTS

| | | | |
|---|---|---|---|
| EP | 1 925 775 | A1 | 5/2008 |
| EP | 2 085 367 | A2 | 8/2009 |
| FR | 1200989 | A | 12/1959 |
| FR | 2 988 770 | A1 | 10/2013 |
| FR | 3 012 513 | A1 | 5/2015 |
| GB | 2 013 757 | A | 8/1979 |
| RU | 2 277 147 | C1 | 5/2006 |
| RU | 2 403 218 | C2 | 11/2010 |

OTHER PUBLICATIONS

J. Yusong, "Construction Technology of Underground Engineering," Wuhan University of Technology Press, The First Edition, p. 108, Aug. 31, 2008.

May 3, 2018 Office Action issued in Chinese Application No. 201580026159.3.

Jun. 20, 2018 Office Action issued in Russian Application No. 2016149893/03(080168).

* cited by examiner

CONSTRUCTION ELEMENT FOR CREATING A TUNNEL, TUNNEL COMPRISING SUCH AN ELEMENT AND METHODS FOR CONSTRUCTING SUCH AN ELEMENT AND SUCH A TUNNEL

BACKGROUND OF THE INVENTION

The invention relates to the creation of tunnels, in particular underground tunnels, and to the construction elements of such tunnels.

STATE OF THE ART

In the field of tunnels, a cavity is in general excavated underground, and a tunnel is then formed in this cavity using voussoirs. The voussoirs correspond to elements constituting an annular section of the tunnel once assembled to one another. When a cavity is excavated in the ground, the equilibrium of the ground is modified and the latter exerts more or less intense thrusts which tend to close the cavity thus formed, this phenomenon being called "ground convergence".

French Patent application FR1200989 can be cited, which discloses a ground convergence damping system comprising a coating covering an outer wall of a tunnel and which comprises devices each provided with a pass-through hole. These devices with a pass-through hole create a free space in the coating, referred to as residual volume, which participates in particular in damping the convergence of the ground. In particular, the thrust of the ground tends to occupy the residual volume, i.e. the volume left unoccupied by the devices, which enables the thrust to be dampened. But to create the coating, the devices have to be injected in a delineated space between the outer wall of the tunnel and the inside wall of the ground. However, when construction of the tunnel is performed, ground elements may agglutinate in the delineated space and hamper injection of the devices, which may prevent the devices from being laid in homogeneous manner around the outer wall of the tunnel.

British Patent application GB 2013757 can also be cited, which discloses a method for creating a tunnel from prefabricated concrete voussoirs. Before being used for creating the tunnel, each prefabricated concrete voussoir comprises a layer of compressible material, such as a polyethylene foam, stuck on the outer surface of the voussoir. But the foam is not stable and can disaggregate in time, resulting in a loss of its mechanical compression and deformation properties. Furthermore, such a foam of synthetic material may be polluting.

It is therefore advantageous to provide a construction element suitable for creating tunnels, and a tunnel constructed from such an element, and in particular to provide methods for constructing such an element and such a tunnel.

OBJECT OF THE INVENTION

One object of the invention consists in remedying the shortcomings set out above and in particular in providing means that are easy to achieve and implement to dampen the ground convergence exerted on a tunnel.

According to one aspect, a construction element is proposed for creating a tunnel, comprising a first incompressible layer of concrete and a second compressible layer securely fastened to the first layer to form a monoblock prefabricated construction element configured to be integrated in a section of the tunnel.

The second layer comprises a plurality of devices each having a solid body integrating an empty space.

A prefabricated construction element suitable for creating a section of a tunnel is thus provided. Such a monoblock construction element is easy to handle and its manufacturing can be monitored so as to obtain a homogeneous tunnel section, in order to master the behaviour of the tunnel as regards the ground convergence. Furthermore, the empty spaces of the devices determine the compressibility of the second layer. In other words the empty spaces enable the ground to converge and to release the stresses exerted on the first layer.

The second layer can comprise devices each provided with a pass-through hole.

The second layer can also comprise devices for which the solid body delineates at least one closed cavity.

The solid body of the devices can be made from ceramic.

The solid body of the devices can be coated with an adhesive film to fasten securely the devices to the first layer.

The adhesive foam can be made from a mortar.

The construction element can further comprise a third protection layer situated on the second layer. The second layer is thus protected to preserve its integrity, for example during transport of the construction element before the latter is fitted in place in a section of the tunnel.

According to another aspect, a tunnel is proposed situated inside a cavity excavated in a ground, at least one section of the tunnel being created from at least one two-layer construction element as defined in the foregoing.

Each two-layer construction element can comprise a third protection layer situated on the second layer, and the tunnel can comprise a filling product occupying a free space delineated between the third protection layer and the ground.

According to another aspect, a method for producing a construction element for creating a tunnel has been proposed, comprising the following steps:

- producing a first incompressible layer of concrete; and
- producing a second compressible layer securely fastened to the first layer to form a monoblock prefabricated construction element configured to be integrated in a section of the tunnel.

In this method, the second layer is produced from a plurality of devices each having a solid body integrating an empty space.

The second layer can comprise devices each provided with a pass-through hole and/or devices for which the solid body delineates at least one closed cavity.

Production of the second layer can comprise the following steps:

- coating the solid body of the devices with an adhesive film; and
- pouring the coated devices on the first layer.

The method can also comprise a protection step wherein a third protection layer is laid on the second layer.

According to yet another aspect, a method for constructing a tunnel is proposed comprising the following steps:

- forming a cavity in the ground by means of a tunnel boring machine;
- forming sections of the tunnel situated inside the cavity, at least one section being created from at least one two-layer construction element as defined in the foregoing, as the tunnel boring machine progressively advances.

Each two-layer construction element can comprise a third protection layer situated on the second layer, and a free space delineated between the third protection layer and the ground can be filled in by means of a filling product.

BRIEF DESCRIPTION OF THE DRAWINGS

Other advantages and features will become more clearly apparent from the following description of particular embodiments and implementations of the invention given for non-restrictive example purposes only and represented in the appended drawings, in which.

DETAILED DESCRIPTION

In general manner, although the present invention procures particular advantages in the field of tunnels, it is also applicable to any system which is created in an underground cavity and which is configured to resist the ground convergence, for example partially or totally buried receptacles or tanks.

Figure 1:
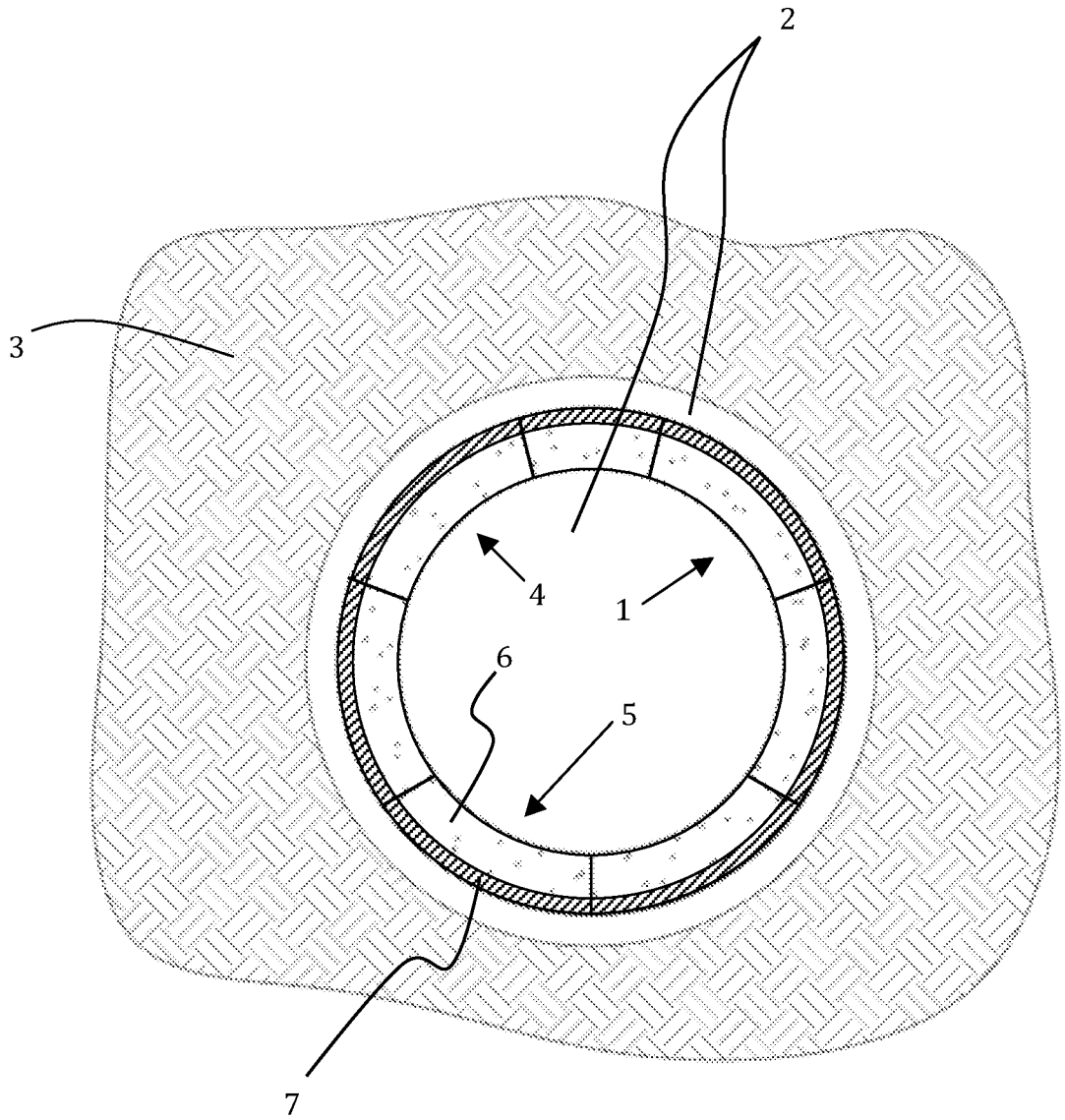
FIG. 1 schematically represents a cross-sectional view of an embodiment of a tunnel according to the invention.

In FIG. 1, a tunnel 1 created in a cavity 2 excavated in a ground 3 has been represented, in other words an underground tunnel. The tunnel 1 can be open and be reverse U-shaped, and can also be closed and can have an oval shape or any other shape. Preferentially, the tunnel 1 has a globally tubular shape. The tunnel 1 comprises sections 4 situated within the cavity 2. At least one section 4, and preferably each section 4, is created from construction elements 5 assembled to one another. At least one construction element 5 comprises a first incompressible layer 6 of concrete. For example, when the sections 4 of the tunnel 1 have an annular shape, the first layer 6 has the shape of a curved hexahedron. The construction element 5 further comprises a second compressible layer 7 securely fastened to the first layer 6 to form a prefabricated construction element 5 of monoblock type. The construction element 5 is prefabricated, i.e. it is made before the tunnel 1 is created. In other words, the construction element 5 is created beforehand, and several construction elements 5 are then assembled to one another so as to create a section 4 of the tunnel 1. The necessity of forming a damping coating by injection of material between a voussoir and the ground 3 is thereby avoided. The construction element 5 does in fact previously incorporate a compressible layer 7, and therefore has an integrated mechanical damping property. Furthermore, what is meant by monoblock element is a movable element which keeps its physical integrity and its mechanical properties when transported, for example when the element is moved from its manufacturing area to the location of the section 4 of the tunnel 1 where it is placed. In other words, the construction element 5 is configured to be integrated in a section 4 of the tunnel 1, and in particular in a section 4 which is being created.

Figure 2:
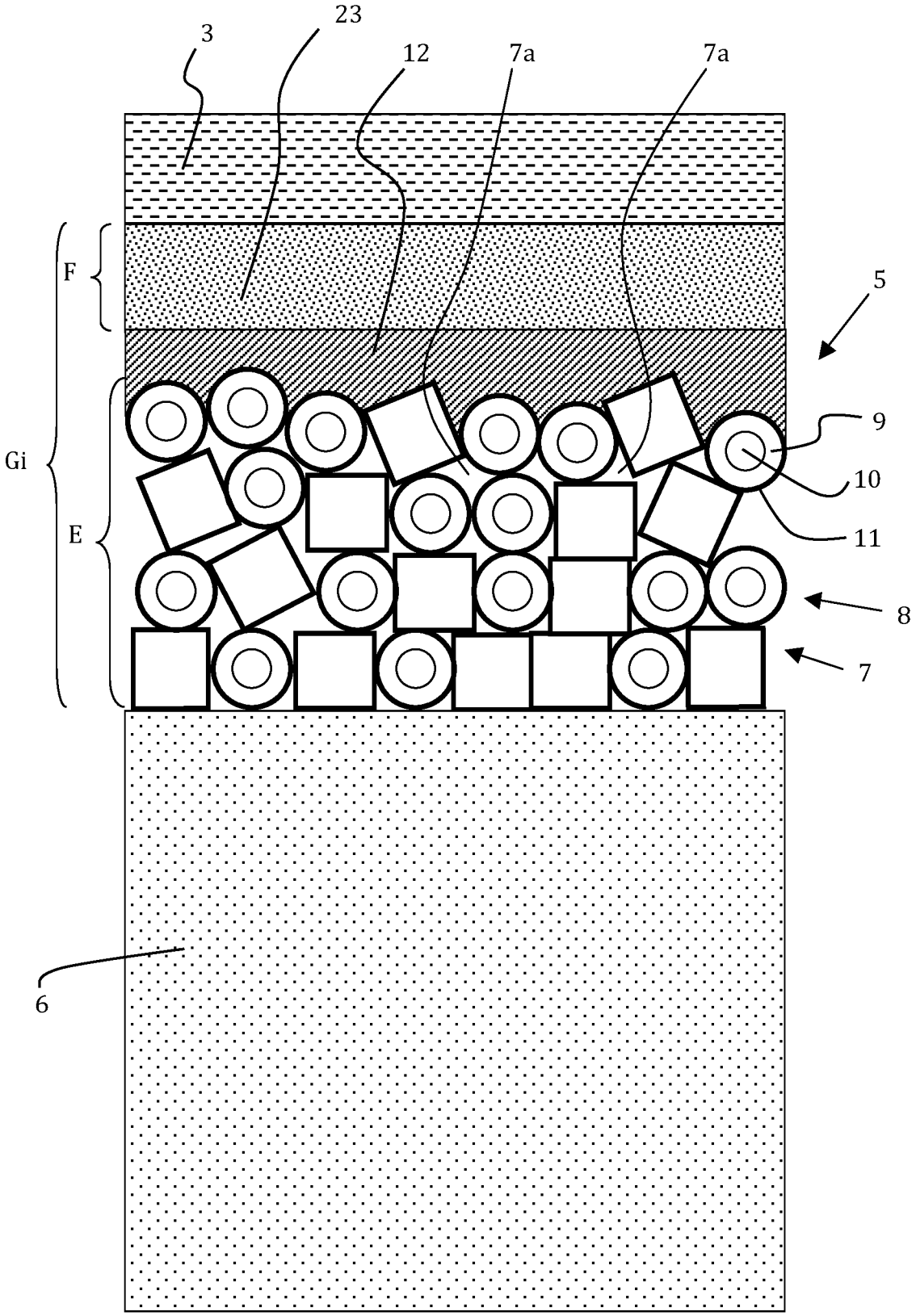
FIG. 2 schematically represents an embodiment of a construction element according to the invention.
Figure 8:
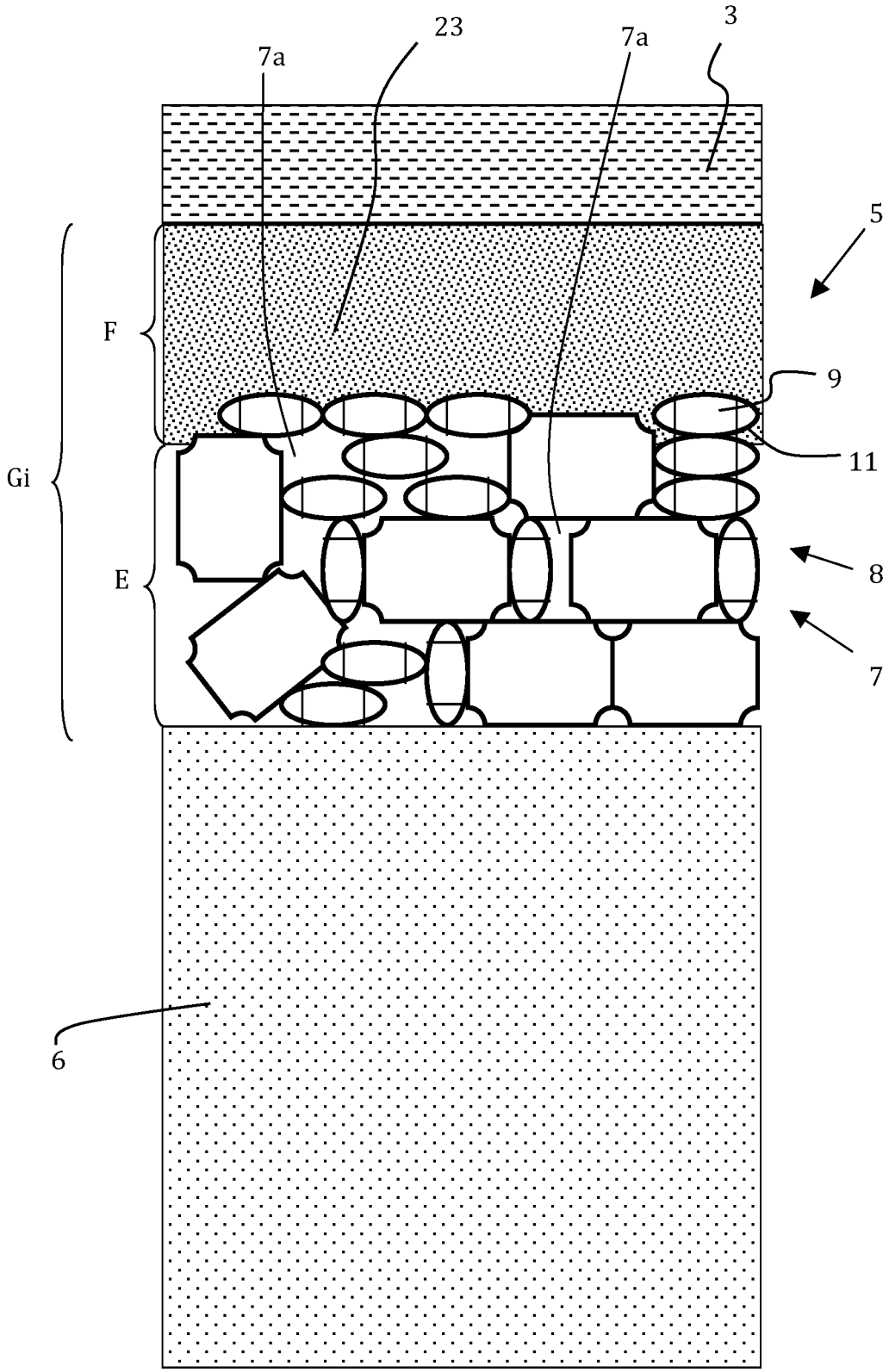
FIG. 8 schematically represents another embodiment of a construction element.

In general manner, the second layer 7 comprises several devices 8, as illustrated in FIGS. 2 and 8, each having a solid body 9 integrating an empty space 10. What is meant by empty space integrated in a body is a closed or open cavity delineated by the body of the device. The second layer 7 is compressible, i.e. it can deform when convergence of the ground 3 takes place. In particular, the devices 8 have a deformable solid body 9. This means that the devices can deform, by breaking or curving, in particular on account of their empty space 10, to enable deformation of the second layer 7. The second layer 7 further comprises gaps 7*a*, i.e. empty spaces, situated between the devices 8. A compressible layer 7 having a residual volume is thus provided, constituted by the sum of the empty spaces of each of the devices 8 and the gaps 7*a*, which provides a damping property of the convergence of the ground 3. Indeed, in the initial state, the ground 3 exerts an initial convergence pressure on the tunnel 1. On account of the movements of the ground 3, the latter will tend to converge towards the inside of the cavity 2. Deformation of the devices 8 will thus enable the ground 3 to move progressively towards the inside of the tunnel 1, until the ground 3 occupies a state of equilibrium. In the state of equilibrium, the convergence pressure is lower than the initial pressure. The second compressible layer 7 therefore enables the ground convergence to be dampened until a state of equilibrium is achieved for which the convergence pressure is supported by the construction element 5, i.e. the first incompressible layer 6 does not break under the convergence pressure at equilibrium.

For example, the devices 8 can be made from ceramic. Ceramic provides a good resistance while at the same time being breakable to efficiently dampen the convergence of the ground 3. When the bodies 9 of the devices 8 break, the ground 3 can converge towards the inside of the tunnel 1. The devices 8 can also be made from glass, from cement, or from mortar which are, just like ceramic, materials which can be broken by the effect of the convergence of the ground 3. As a variant, the devices 8 can be made from metal or from a deformable plastic material. When the devices 8 have a deformable body, they also enable the ground convergence to be dampened.

In FIG. 2 a preferred embodiment has been represented, wherein devices 8, of the second compressible layer 7, each comprise a body 9 provided with a pass-through hole 10 (subsequently illustrated in FIGS. 4 to 7). The construction element 5 integrated in a section of a tunnel has also been represented in FIG. 2. The prefabricated construction element 5 is monoblock and comprises the first layer 6 of concrete and the second compressible layer 7 formed by the devices 8. When the first layer 6 has the shape of a curved hexahedron, the construction element 5 then forms a voussoir with a compressible part 7 configured to form an annular section of the tunnel 1. The thickness E of the second layer 7 is chosen according to the damping of the convergence of the ground 3 that is desired to be obtained. In particular the thickness E is chosen according to the movement of the ground 3 with respect to its initial position, which can be supported by the construction element 5. In the initial position, the ground 3 is at an initial distance Gi from the outer surface of the first layer 6. The initial distance Gi corresponds to the sum between the initial thickness E of the second layer 7, the thickness of the third protection layer 12, and the thickness of the free space F. Furthermore, the thickness E also depends on the compressibility of the devices 8. The devices 8 are further coated with an adhesive film 11 to securely fasten them to the first layer 6. In particular the adhesive layer 11 enables the devices 8 to be securely fastened to one another and to the first concrete layer 6. In this manner, the construction element 5 is monoblock and is movable to be integrated in the section of the tunnel when formation of the latter takes place. The adhesive film 11 preferably comprises mortar which adheres efficiently to the concrete first layer 6. The mortar for its part comprises cement, sand and water. The mortar is hardenable and hardens to agglutinate the devices 8 to one another and to enable the devices to adhere to the first layer 6. In particular, the adhesive film 11 coats the outer surface of the device 8, without obstructing the pass-through hole 10. Other adhesive elements can be used to coat the devices 8, for example an epoxy resin glue, etc.

Advantageously, the construction element 5 can comprise a third protection layer 12 situated on the second layer 7. More particularly, the third protection layer 12 is a thin layer compared with the first and second layers 6, 7. In general manner, the third protection layer 12 is bonded to the second layer 7 to mechanically fasten it to the second layer 7. The third protection layer 12 protects the second layer 7 from shocks, for example when the construction element 5 is handled, to prevent breaking of the bodies 9 of the devices 8, in particular those that are located at the periphery of the construction element 5. In general manner, when the section of a tunnel is created, a free space F is generally created between the inner surface of the cavity and the outer surface of the section of the tunnel, i.e. the outer surface of the construction element 5. When the construction element 5 does not comprise a third protection layer, the outer surface of the section corresponds to the outer surface of the second layer 7, as illustrated in FIG. 8. When the construction element 5 comprises a third protection layer 12, the outer surface is that of the third protection layer 12, as illustrated in FIG. 2. However, so that the ground 3 does not collapse into the free space F and break the section, a filling product 23, such as mortar or gravel, is injected to fill this free space F. In the case where the second layer 7 comprises devices 8 with a pass-through hole 10, a third protection layer 12, which is in addition impervious to the filling product 23 used to fill the free space F, is laid on the second layer 7. In this case, the third protection layer 12 in particular prevents the pass-through holes 10 of the first layers of devices 8 from being filled with the filling product 23. The third protection layer 12 prevents the mortar or gravel from penetrating into the pass-through holes 10, which would reduce the damping properties of the construction elements 5. The third protection layer 12 enables the second compressible layer 7 to be isolated from the filling product 23. The third protection layer 12 thus preserves the residual volume before deformation of the second layer 7, which guarantees damping of the convergence of the ground 3. The third protection layer 12 can made from plastic or from mortar.

Figure 3:
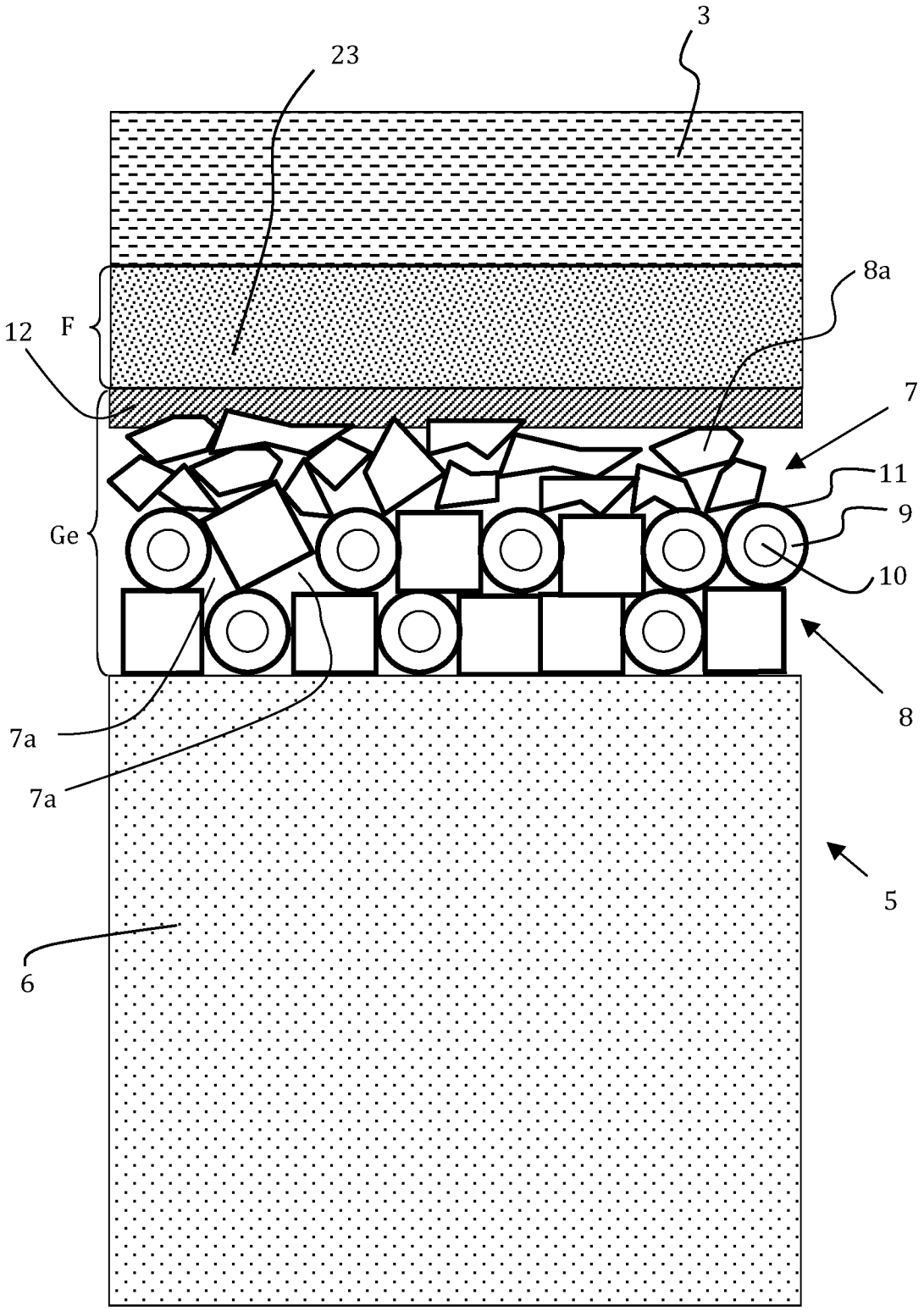
FIG. 3 schematically represents a state of equilibrium after ground convergence.

When the ground 3 converges, as illustrated in FIG. 3, the second compressible layer 7 is deformed and enables movement of the ground 3 towards the centre of the tunnel. The ground 3 can break or deform the devices 8, until a state of equilibrium has been reached in which the ground 3 is at an equilibrium distance Ge from the outer surface of the first layer 6. The equilibrium distance Ge is smaller than the initial distance Gi. The breaking resistance of the devices 8 is lower than the convergence pressure of the ground so as to allow crushing of the devices 8. Broken devices have been represented by the reference 8*a*. In other words, all or some of the devices 8 can comprise a state in which they are broken. This enables the movements of the ground 3 to be absorbed without damaging the tunnel.

Figure 4:
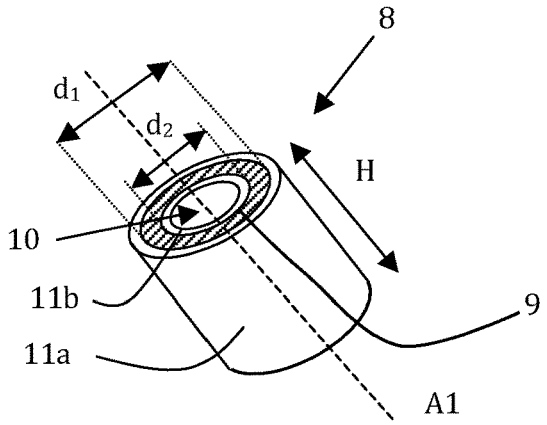
FIG. 4 schematically represents a perspective view of an embodiment of a device provided with a pass-through hole.
Figure 5:
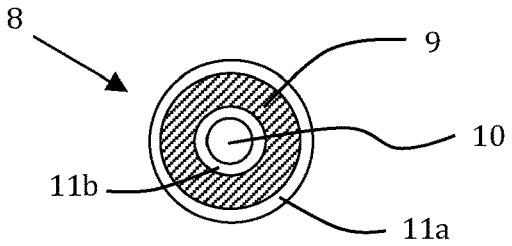
FIG. 5 schematically represents a cross-sectional view of the device of FIG. 4.

FIGS. 4 to 7 illustrate two embodiments of a device 8 provided with a pass-through hole 10 able to be used in the second compressible layer 7 of the construction element 5. In FIGS. 4 and 5, the device 8 is in the form of a tube comprising a pass-through hole 10 corresponding to a recess along a longitudinal axis A1 of the tube. The device 8 can also comprise several pass-through holes, and preferentially each device 8 comprises a single pass-through hole to facilitate production thereof. Advantageously, each device 8 in the form of a tube has a height H, an external diameter $d_1$ and an internal diameter $d_2$. Preferentially, the height H is equal to the external diameter $d_1$, in order in particular to obtain a second layer 7 having a substantially constant thickness E. These dimensions enable the tubular devices 8 to support a calculated load before breaking. The device 8 is also coated with an adhesive film 11*a* which surrounds the outer surface of the device 8. Depending on the coating method, an adhesive film 11*b* can be deposited on the inner wall of the pass-through hole 10 without obstructing it. The devices 8 can for example be poured into a mortar and a sieve can be used to eliminate the excess mortar. In this case, as illustrated in FIGS. 4 and 5, a mortar film 11*a* coats the outer surface of the devices and another mortar film 11*b* adheres to the inner wall of the pass-through hole 10 without obstructing it. According to another embodiment, the pass-through hole 10 of the devices 8 is isolated, and the outer surface of the devices 8 is coated with an adhesive layer 11. In this case, as illustrated in FIG. 2, the inner wall is not coated with an adhesive layer, which guarantees that a larger empty space is obtained within the devices.

Figure 6:
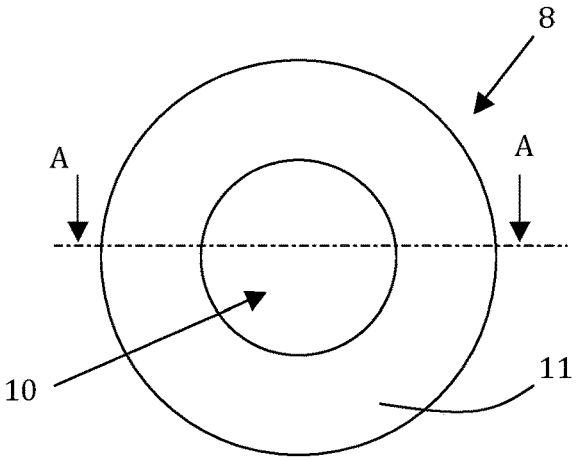
FIG. 6 schematically represents a top view of another embodiment of a device provided with a pass-through hole.
Figure 7:
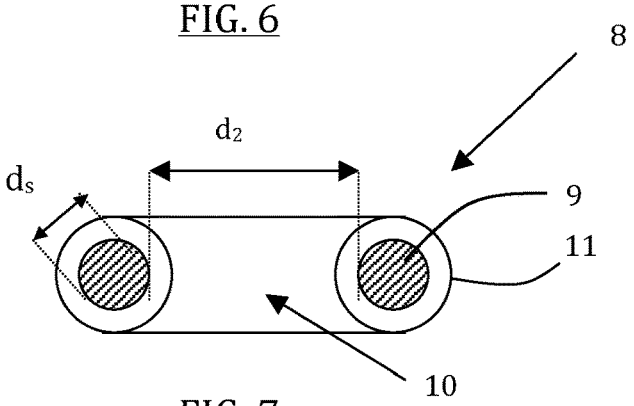
FIG. 7 schematically represents a cross-sectional view along the line A-A of FIG. 6.

In FIGS. 6 and 7, another embodiment of a device 8 with pass-through hole 10 has been represented having a form of a ring. The ring can be toroidal and can present a circular cross-section as illustrated in FIG. 6. A ring can have a torus diameter $d_s$ and an internal diameter $d_i$. In this embodiment, the adhesive film 11 surrounds the outer surface of the body 9 of the device 8, penetrating partially into the pass-through hole 10, without obstructing it.

Preferably, the devices (tubes or rings) arranged inside the second layer 7 are all substantially identical in order to obtain a homogeneous second layer 7. In other words, they cannot nest in one another. The second layer 7 preferably comprises devices 8 having a globally tubular shape as they are easier to produce than devices 8 of globally annular shape.

In FIG. 8 another embodiment of the second compressible layer 7 has been represented. In this other embodiment, devices 8 each comprise a solid body 9 delineating at least one closed cavity (illustrated further in FIGS. 9 to 11). The construction element 5 is monoblock and comprises the first layer 6 of concrete and the second compressible layer 7 formed by the devices 8. In this embodiment, it is not necessary for the construction element 5 to comprise a third protection layer 12. Indeed, the body 9 of the devices 8 delineating one or more closed cavities prevent mortar or gravel injected in the free space F from entering into these cavities. The construction element 5 can nevertheless comprise devices having a body delineating one or more closed cavities and a third protection layer 12 to protect the second layer 7 when movement of the element 5 is performed, in order in particular to avoid breakage of the devices 8 during transport. In this case, the third protection layer 12 guarantees the tightness for the second layer 7, preventing the filling product 23 from filling the gaps 7*a*.

Figure 9:
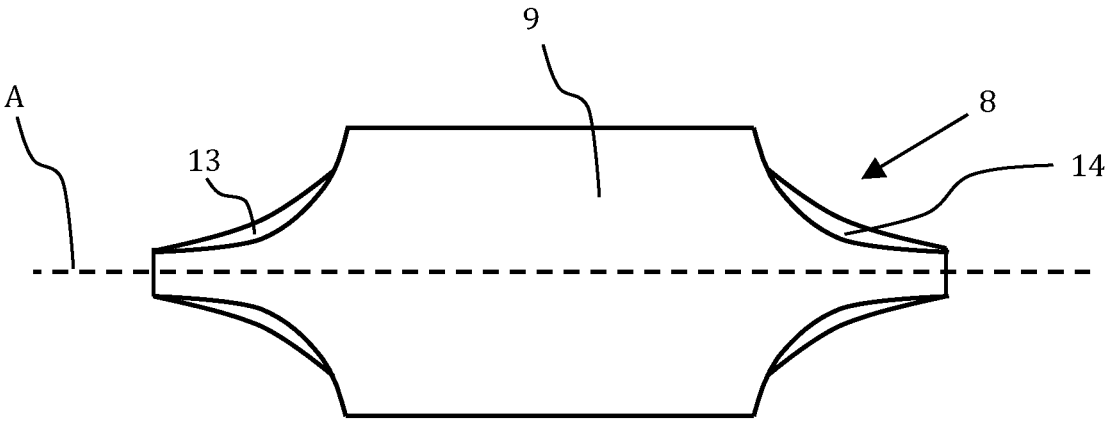
FIG. 9 schematically represents a perspective view of an embodiment of a device provided with a closed cavity.
Figure 10:
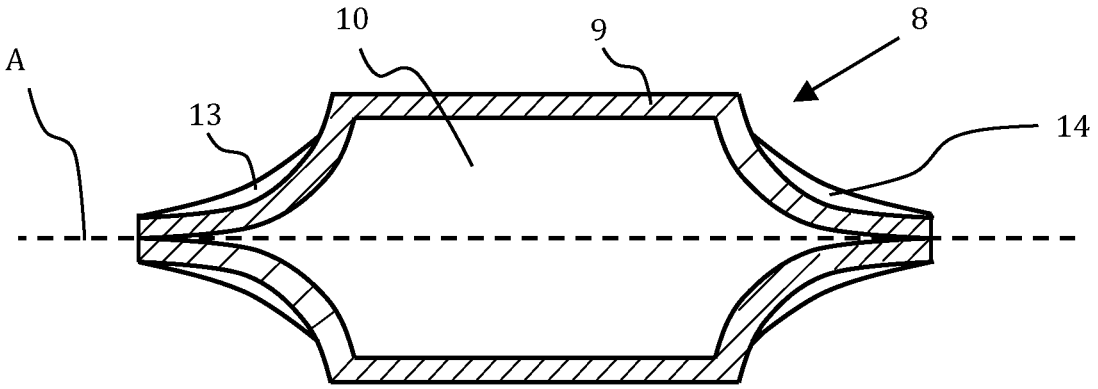
FIG. 10 schematically illustrates a cross-sectional view of the device of FIG. 9.
Figure 11:
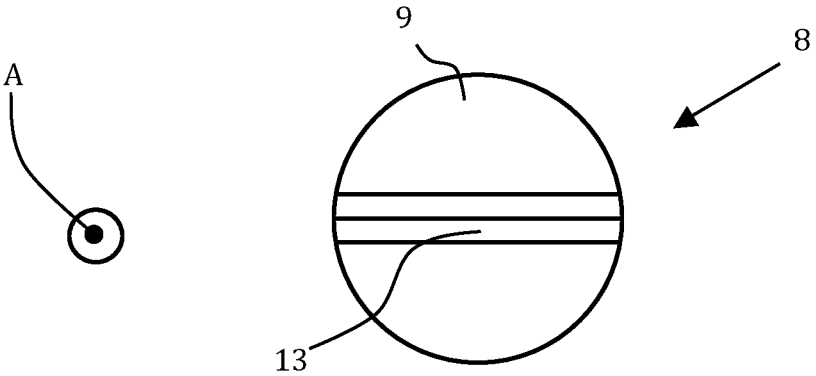
FIG. 11 schematically illustrates a left-side front view of the device of FIG. 9.

FIGS. 9 to 11 illustrate an embodiment of a device 8 the body 9 of which delineates at least one closed cavity 10. Preferentially, the device 8 has a solid body 9 made from ceramic. Ceramic is suitable for manufacturing these devices 8, as it is malleable before a firing step so as to be able to form the closed cavity 10 within the device 8, and as it becomes solid after firing. What is meant by closed cavity 10 is an empty space enclosed within the device 8. The solid body 9 of the device 8 is in particular liquid-proof, for example tightly sealed to prevent mortar in liquid phase before hardening from penetrating therein. For example, the body 9 of the device 8 extends along a longitudinal axis A of the device 8 and comprises two closed ends 13, 14. The closed ends 13, 14 can each have a linear shape. In a first embodiment, as illustrated in FIGS. 9 and 10, the ends 13, 14 are parallel to one another. As a variant, the ends 13, 14 can be perpendicular to one another. For example, the body 9 of the device 8 has a cylindrical shape. What is meant here by cylinder is a solid limited by a cylindrical surface generated by a straight line, noted generating line, moving along a closed flat curve, noted base line, and two parallel planes bisecting the generating lines. In particular, the body 9 can be in the shape of a tube. The device 8 can also comprise several cavities communicating with one another or not. Advantageously, the closed cavities 10 of the devices 8 prevent them from nesting in one another, whatever their size and shape.

As a variant, the construction element 5 comprises a second compressible layer 7 which can comprise both devices 8 each provided with a pass-through hole 10, and devices 8 the solid body 9 of which delineates at least one closed cavity 10.

In FIGS. 12 to 18, the main steps of an embodiment of a method for producing a construction element 5 as defined in the foregoing have been represented. In general manner, the construction element 5 is produced by performing the following steps:

producing the first incompressible layer 6 of concrete; and producing the second compressible layer 7 securely fastened to the first layer 6 from a plurality of devices 8 each having a solid body 9 integrating an empty space 10, to form a monoblock prefabricated construction element 5 configured to be integrated in a section 4 of the tunnel 1.

The solid bodies 9 of the devices 8 are each provided with a pass-through hole and/or the body of the devices delineates at least one closed cavity.

Figure 12:
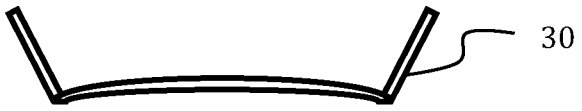
FIGS. 12 to 18 schematically illustrate the main steps of an implementation mode of a method for creating a construction element.
Figure 13:
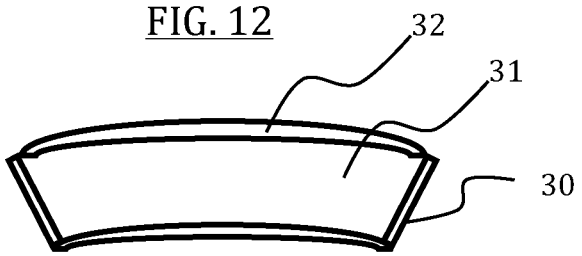
Figure 14:
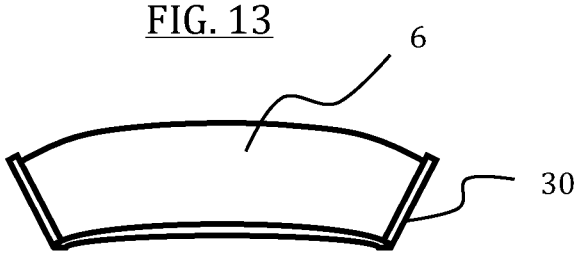
Figure 15:
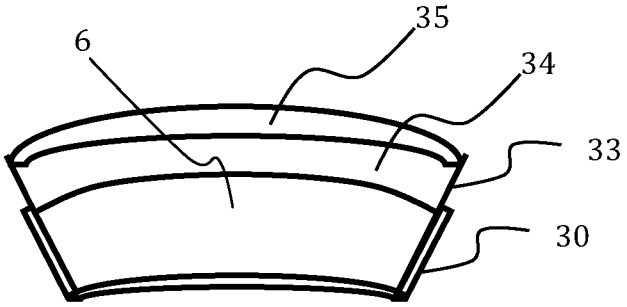
Figure 16:
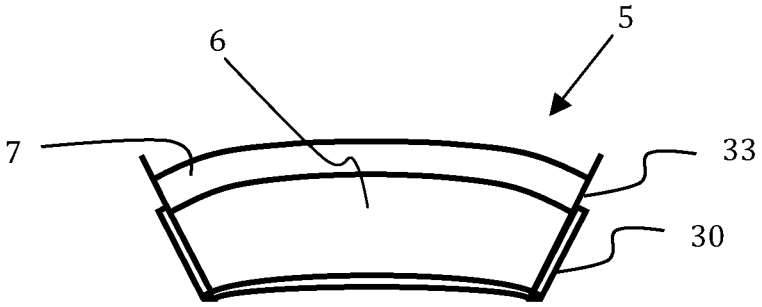
Figure 17:
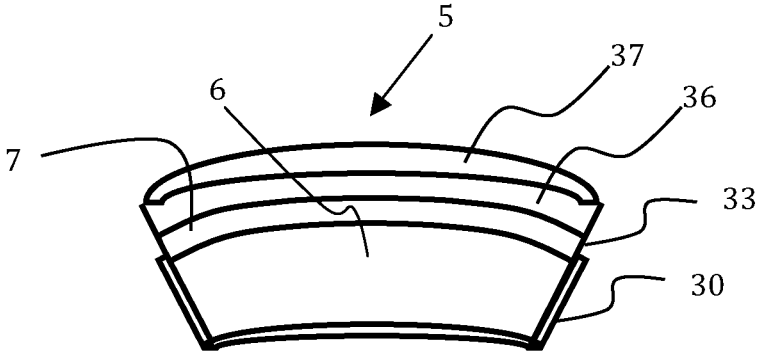
Figure 18:
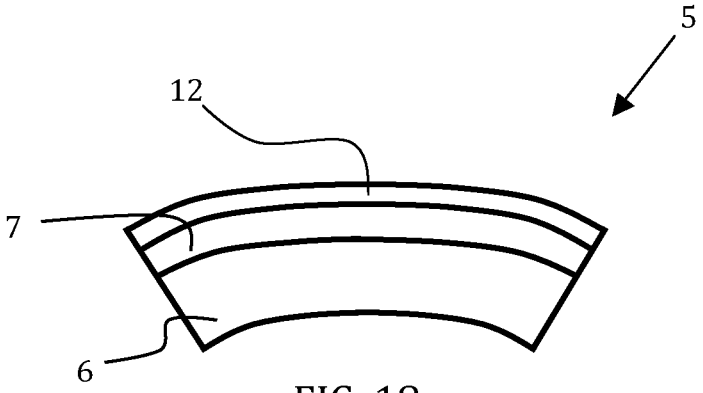

For example, to manufacture the first layer 6 of concrete, an open and curved rectangular framework 30 is used to create the shape of a voussoir, as illustrated in FIG. 12. As a variant, the framework is open and not curved to create tunnel sections of various shapes, for example U-shaped or oval. Liquid concrete 31 is then poured into the framework 30, as illustrated in FIG. 13. Metal bars can also be added in the liquid concrete 31 to obtain an incompressible reinforced concrete first layer. Then a first template 32 is used which is placed on the surface of the concrete 31 and which is moved along the surface in order to form a curved outer surface. The concrete 31 is left to set, either completely and in this case the concrete has totally hardened, or partially and in this case the concrete has not totally hardened but has sufficiently hardened at the surface to preserve the curvature given by the first template 32. The first template 32 is then removed and a first layer 6 is thus obtained having a base and outer surface which are curved, as illustrated in FIG. 14. The solid bodies 9 of the devices 8 have previously been coated with the adhesive film 11. The framework elements 33 are further fixed on the edges of the framework 30 to raise the framework 30 and to be able to form the second layer 7, as illustrated in FIG. 15. The coated devices 34 are then poured into the framework 30, and more particularly on the outer surface of the first layer 6. According to one embodiment, when the coated devices 34 are poured, the concrete of the first layer has not completely hardened. In this embodiment, an adhesive layer 11 made from mortar is used which will adhere to the outer surface of the first layer 6 which has not completely hardened. As a variant, it is possible to wait until the concrete has completely hardened before pouring the devices 8. According to this variant, an adhesive layer 11 made from a glue will be used, for example an epoxy resin glue which adheres with a hard surface made from concrete. Furthermore, when the adhesive film 11 comprises a mortar, the devices 34 coated with the mortar are poured on the first layer 6 before the mortar hardens. The mortar is then left to harden to securely fasten the second compressible layer 7 to the first layer 6. Then a second template 35 is used which is placed and moved on the surface of the coated devices 34 in order to form a curved outer surface on the second layer 7, as illustrated in FIG. 15. Then the adhesive layer 11 is left to adhere so that the devices are bonded to one another and to securely fasten the second layer 7 to the first layer 6. The second template 35 is then removed and a prefabricated monoblock element 5 surrounded by the framework 30 is obtained, illustrated in FIG. 16. As a variant, as illustrated in FIG. 17, a third protection layer can be formed by pouring mortar 36 on the second layer 7 and by moving a third template 37 to curve the outer surface of the third layer. The framework 30 and framework elements 33 are then removed, as is the third template 37 if used, to obtain the monoblock prefabricated construction element 5, as illustrated in FIG. 18.

Figure 19:
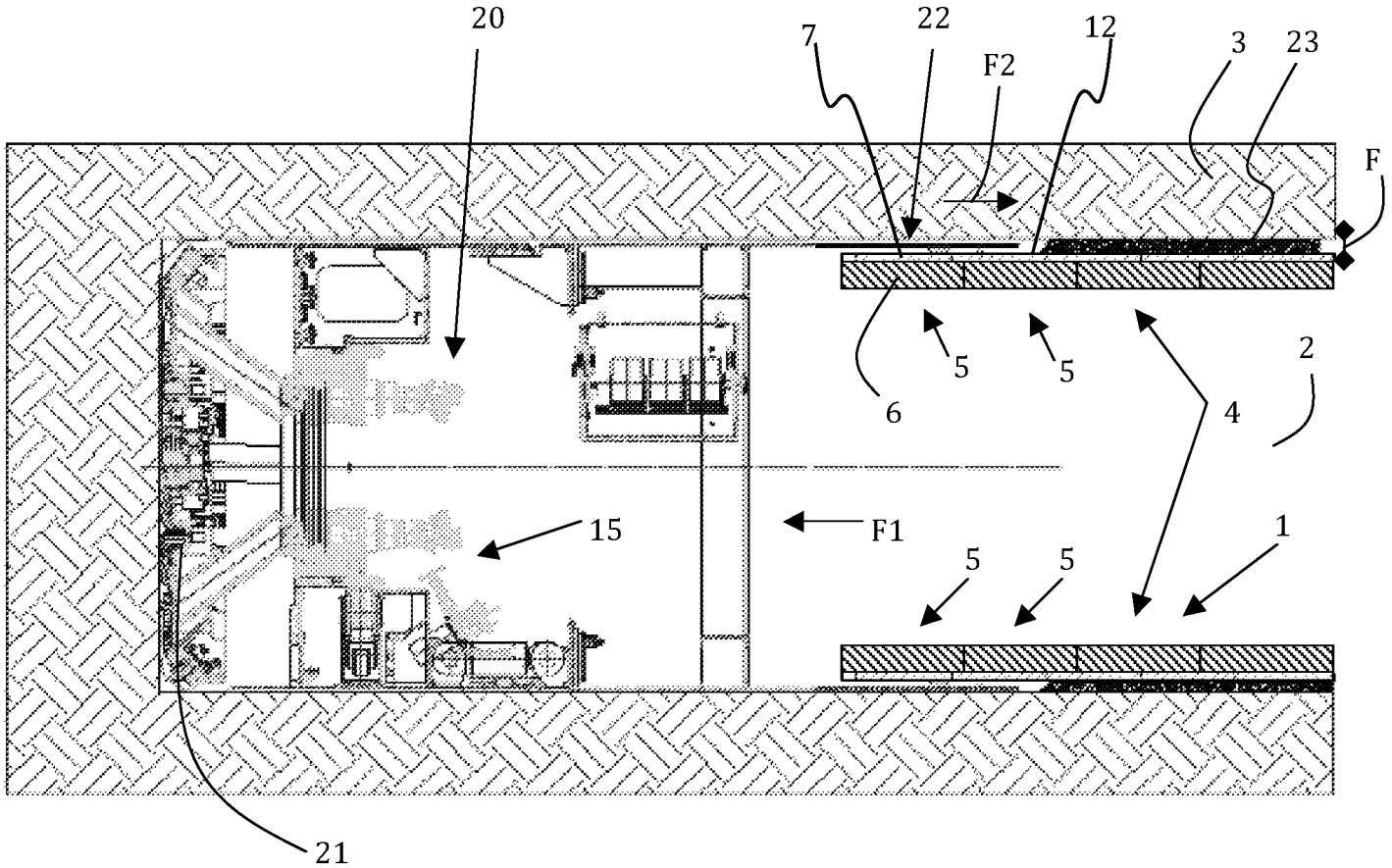
FIG. 19 schematically illustrates a cross-sectional view of a tunnel boring machine creating the tunnel of FIG. 1.
Figure 20:
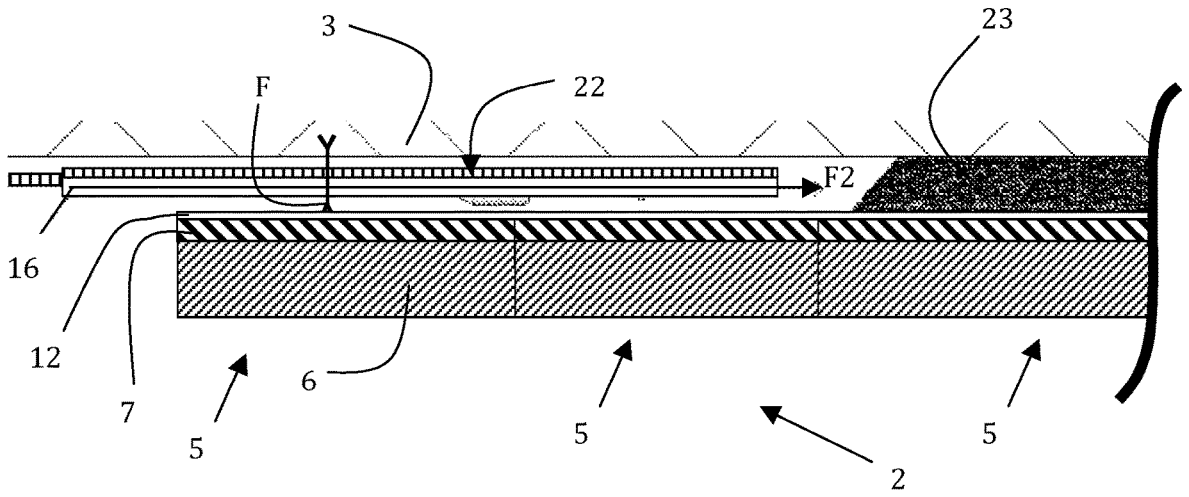
FIG. 20 schematically illustrates a cross-sectional view of a detail of FIG. 19.

An embodiment of creation of the tunnel 1 described in the foregoing in FIG. 1 has been represented in FIGS. 19 and 20. According to this embodiment, a tunnel boring machine 15 excavates the cavity 2 in the ground 3 in the direction F1. The front of the tunnel boring machine 20 is equipped with means 21 for demolishing the rock of the ground 3 and comprises means for extracting the rock, not represented for the purposes of simplification. A part of the tunnel boring machine 15 performs placing of the construction elements 5 as the tunnel boring machine 15 progressively advances in the direction F1. The tunnel boring machine 15 further comprises injection means 22 to inject a filling product 23, for example mortar or gravel, to fill the free space F delineated between the construction elements 5 and the inner wall of the cavity 2 formed by the progression of the tunnel boring machine 15. The arrow, indicated by the reference F2, illustrates the path taken by the filling product 23 when the latter is injected. Injection of the filling product 23 enables a filling layer to be formed to occupy the free space F between the construction elements 5 and ground 3.

In general manner, the method for creating the tunnel comprises the following steps:

forming the cavity 2 in the ground 3 by means of the tunnel boring machine 15;

forming sections 4 of the tunnel 1 situated inside the cavity 2, at least one section 4 being created from at least one construction element 5, as defined in the foregoing, as the tunnel boring machine 15 progressively advances.

More particularly, when creating a section 4 of the tunnel 1, a free space F delineated between the outer wall of the tunnel 1 and the inner wall of the cavity 2 is preserved, to place the construction elements in order to form the section 4 of the tunnel 1. The free space F is then filled with the filling product 23.

The construction element which has just been described facilitates construction of a tunnel while at the same time guaranteeing damping of the convergence of the ground in which the tunnel is situated. Furthermore, it ensures a better mastery of the creation method of the tunnel. Such a construction element enables the thickness of a conventional voussoir to be reduced, which greatly reduces the quantity of concrete necessary to create the tunnel.

The invention claimed is:

1. Construction element for creating a tunnel, comprising:

a first incompressible layer of concrete, a second compressible layer securely fastened to the first layer to form a monoblock prefabricated construction element configured to be integrated in a section of the tunnel, wherein the second layer comprises a plurality of devices each having a solid body integrating an empty space, and the solid body of the devices is coated with an adhesive film to securely fasten the devices to the first layer, and a third protection layer situated on the second layer, wherein the third protection layer is bonded and mechanically fastened to the second layer to protect the second layer from shocks.

2. Construction element according to claim 1, wherein the devices are each provided with a pass-through hole.

3. Construction element according to claim 1, wherein the devices have a solid body delineating at least one closed cavity.

4. Construction element according to claim 1, wherein the solid body of the devices is made from ceramic.

5. Construction element according to claim 1, wherein the adhesive film comprises mortar.

6. Construction element according to claim 1, wherein the solid body of the devices is made from glass.

7. Construction element according to claim 1, wherein the solid body of the devices is made from metal.

8. Construction element according to claim 1, wherein the solid body of the devices is made from a deformable plastic material.

9. Construction element according to claim 1, wherein the solid body of the devices is configured to break upon deformation of the second compressible layer.

10. Construction element according to claim 1, wherein the solid body of the devices is configured to deform but not break upon deformation of the second compressible layer.

11. Tunnel situated inside a cavity excavated in a ground, at least one section of the tunnel being created from at least one construction element according to claim 1.

12. Tunnel according to claim 11, wherein a filling product occupies a free space delineated between the third protection layer and the ground.

13. Method for constructing a tunnel comprising the following steps:

forming a cavity in a ground by means of a tunnel boring machine;

forming sections of the tunnel situated inside the cavity, at least one section being created from at least one construction element according to claim 1 as the tunnel boring machine progressively advances.

14. Method for producing a construction element for creating a tunnel, comprising the following steps:

producing a first incompressible layer of concrete;

producing a second compressible layer securely fastened to the first layer to form a monoblock prefabricated construction element configured to be integrated in a section of the tunnel;

wherein the second layer is produced from a plurality of devices each having a solid body integrating an empty space, and wherein production of the second layer comprises the following steps:

coating the solid body of the devices with an adhesive film; and pouring the coated devices on the first layer; and laying a third protection layer on the second layer, wherein the third protection layer is bonded and mechanically fastened to the second layer to protect the second layer from shocks.

15. Method according to claim 14, wherein the body of the devices have a pass-through hole.

16. Method according to claim 14, wherein the devices have a solid body delineating at least one closed cavity.

* * * * *